US005702310A

United States Patent [19]

Wozny

[11] Patent Number: 5,702,310

[45] Date of Patent: Dec. 30, 1997

[54] GOLF CLUB WITH ADJUSTABLE MALE HOSEL AND FERRULE

[75] Inventor: Thomas A. Wozny, Mt. Prospect, Ill.

[73] Assignee: Wilson Sporting Goods Co., Chicago, Ill.

[21] Appl. No.: 712,360

[22] Filed: Sep. 11, 1996

[51] Int. Cl.[6] ..... A63B 53/02

[52] U.S. Cl. ..... 473/308

[58] Field of Search ..... 473/305, 306, 473/307, 308, 309, 310, 312

[56] References Cited

U.S. PATENT DOCUMENTS

| | | | |
|---|---|---|---|
| 796,802 | 8/1905 | Brown | 473/307 |
| 1,818,553 | 8/1931 | Hadden | 473/306 |
| 1,829,900 | 11/1931 | Johnson | 473/308 |
| 1,958,032 | 5/1934 | Cocke | 473/306 |
| 2,015,253 | 9/1935 | Buhrke | 473/308 |
| 2,363,991 | 11/1944 | Reach | 473/306 |
| 2,470,406 | 5/1949 | Matzie | 473/308 |
| 2,880,002 | 3/1959 | Wetty | 473/349 |
| 3,170,691 | 2/1965 | Pritchard | 473/306 |
| 3,176,987 | 4/1965 | Johnston | 473/309 |
| 3,397,888 | 8/1968 | Springer | 473/248 |
| 3,410,558 | 11/1968 | Ruether, Jr. | 473/309 |
| 3,572,709 | 3/1971 | Risher | 473/308 |
| 3,759,527 | 9/1973 | Witherspoon | 473/306 |
| 3,893,122 | 7/1975 | Florian | 343/705 |
| 3,992,015 | 11/1976 | Benson | 473/312 |
| 4,809,983 | 3/1989 | Langert | 473/305 |
| 4,895,368 | 1/1990 | Geiger | 473/307 |
| 4,984,794 | 1/1991 | Pernelle | 473/309 |
| 5,105,550 | 4/1992 | Shenoha | 33/508 |
| 5,184,819 | 2/1993 | Desbiolles | 473/309 |
| 5,226,652 | 7/1993 | Sato | 473/312 |
| 5,275,408 | 1/1994 | Desbiolles et al. | 473/312 |
| 5,326,106 | 7/1994 | Meyer | 473/305 |
| 5,395,109 | 3/1995 | Fenton, Jr. | 473/324 |
| 5,439,218 | 8/1995 | Gondeck | 473/308 |
| 5,452,890 | 9/1995 | Bingman | 473/310 |

FOREIGN PATENT DOCUMENTS

| | | |
|---|---|---|
| 282301 | 12/1927 | United Kingdom . |
| 332354 | 7/1930 | United Kingdom . |

*Primary Examiner*—Jessica Harrison
*Assistant Examiner*—Stephen L. Blau

[57] ABSTRACT

A golf clubhead includes a male hosel, a tubular ferrule which is positioned over the hosel, and a shaft which is inserted over the male hosel and into the ferrule. The ferrule includes a pair of ends and an internal surface which includes an annular abutment between the ends of the ferrule. The bottom of the shaft abuts the abutment surface of the ferrule.

7 Claims, 4 Drawing Sheets

GOLF CLUB WITH ADJUSTABLE MALE HOSEL AND FERRULE

BACKGROUND

This invention relates to golf clubs, and, more particularly, to a golf club having an adjustable male hosel and ferrule which enables adjustments in the loft and/or lie angle of the club.

Most golf clubs include a female hosel into which the golf club shaft is inserted. The shaft is conventionally bonded to the hosel by epoxy or adhesive. The golf club may include a ferrule at the junction of the hosel and shaft to conceal the joint.

Some golf clubs have included a male hosel which is inserted into the shaft. The shaft usually abuts an annular shoulder on the hosel. A ferrule may also be used to conceal the junction of the hosel and the shaft.

After a golf club is made, it is often desired to change the loft angle and/or the lie angle of the club. A detailed description of loft angle, lie angle, and other characteristics of golf clubs may be found in U.S. Pat. No. 5,105,550. When making loft and lie adjustments on a club with a male hosel, the area where the shaft covers the hosel is often bent. A gap may thereby be created between the end of the shaft and the shoulder on the hosel on one side of the hosel, and an interference or overlapping condition may be created on the other side. The interference condition, combined with the strong bond between the shaft and the hosel, can create excessive stresses at the shoulder/hosel junction and can cause failure of the bond.

SUMMARY OF THE INVENTION

The invention provides a ferrule with an internal abutment which prevents the shaft from completely covering the male hosel and making contact with the annular shoulder of the hosel. The bottom of the shaft engages the internal abutment of the ferrule and is thereby spaced from the shoulder of the hosel. The lower portion of the hosel below the shaft can be bent during loft/lie adjustments without affecting the bond between the hosel and the shaft. The ferrule is made from a relatively soft material which allows the ferrule to deform during adjustments without creating gaps between the ferrule and the hosel or shaft.

DESCRIPTION OF THE DRAWING

The invention will be explained in conjunction with illustrative embodiments shown in the accompanying drawing, in which.

DESCRIPTION OF SPECIFIC EMBODIMENTS

Figure 1:
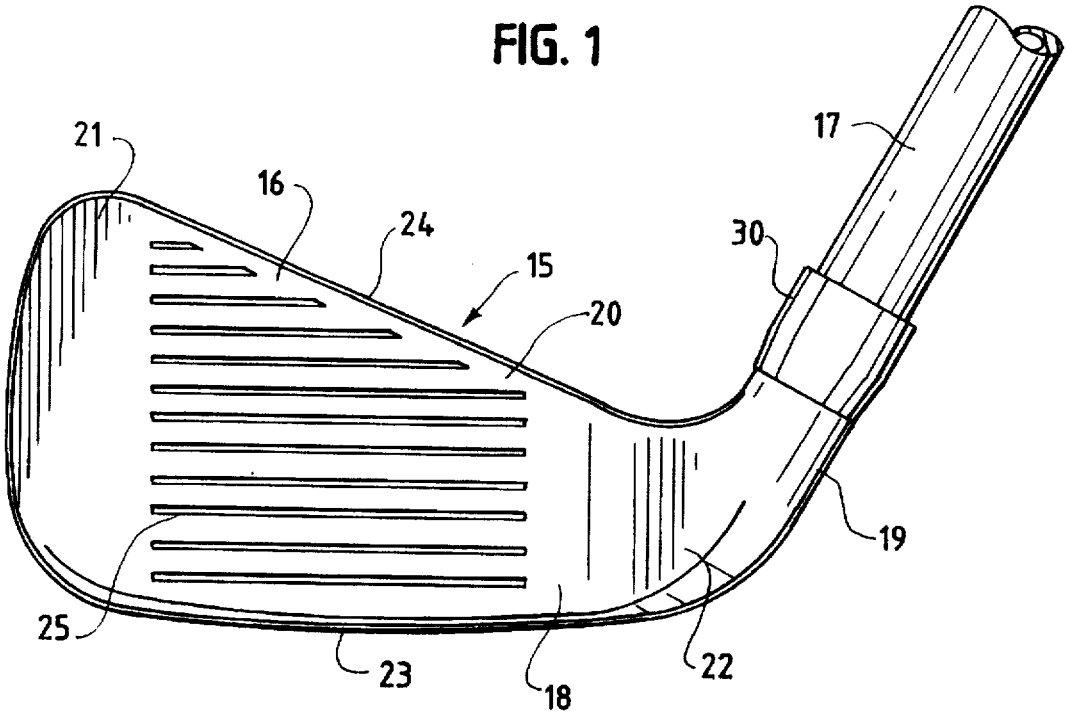
FIG. 1 is a front fragmentary view of a golf club formed in accordance with the invention.
Figure 2:
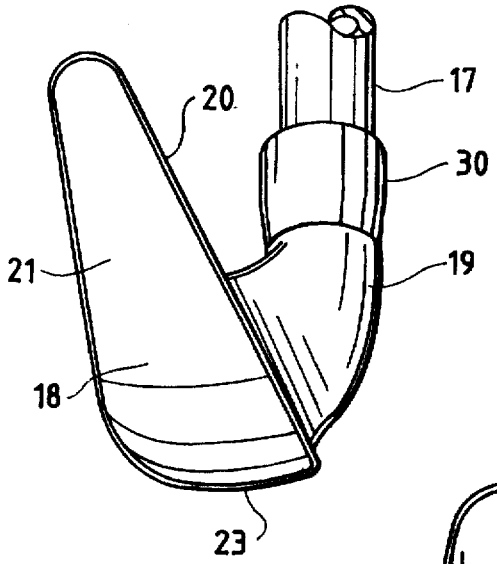
FIG. 2 is a toe end view of the club of FIG. 1.
Figure 3:
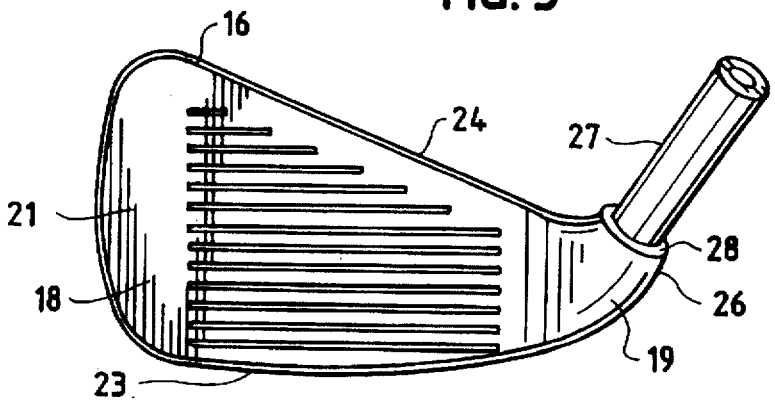
FIG. 3 is a perspective view of the clubhead of FIG. 1 without the shaft and ferrule.

Referring to FIGS. 1–3, a golf club 15 includes a clubhead 16 and a shaft 17. The particular golf club illustrated is an iron type golf club but it will be understood that the invention can also be used with wood type golf clubs.

The clubhead 16 includes a blade portion 18 and a hosel portion 19. The blade portion includes a face 20, a toe portion 21, a heel portion 22, a sole 23, and a top edge 24. The face is provided with conventional grooves 25.

The hosel portion 19 angles upwardly from the heel portion 22 and includes a first generally cylindrical portion 26 (FIG. 3) and a generally cylindrical attaching portion 27. An annular shoulder 28 extends between the two cylindrical portions. The hosel is a male hosel, and the attaching portion is inserted into the hollow tubular shaft 17.

Figure 5:
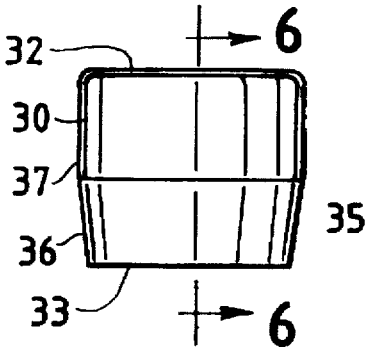
FIG. 5 is an elevational view of the ferrule.
Figure 6:
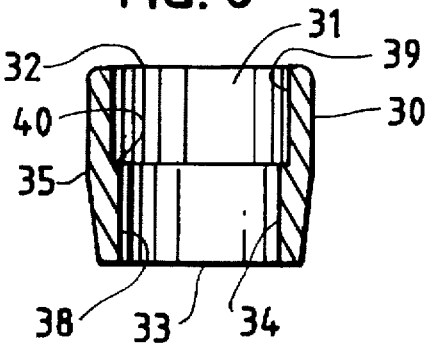
FIG. 6 is a sectional view of the ferrule taken along the line 6—6 of FIG. 5.
Figure 7:
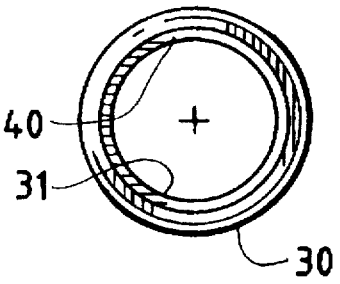
FIG. 7 is a top view of the ferrule.

A generally cylindrical ferrule 30 covers the junction between the bottom of the shaft and the hosel. Referring to FIGS. 5–7, the ferrule is tubular and has an internal bore 31, upper and lower ends 32 and 33, and inner and outer surfaces 34 and 35. In the particular embodiment illustrated, the outer surface 35 includes a lower tapered portion 36 and an upper cylindrical portion 37. However, the outer surface can be entirely cylindrical if desired. The inner surface 34 includes a first cylindrical portion 38 adjacent the lower end 33 of the ferrule and a second cylindrical portion 39 adjacent the upper end of the ferrule which has a diameter larger than the diameter of the lower cylindrical portion 38. An annular shoulder 40 extends between the two cylindrical portions 38 and 39.

Figure 4:
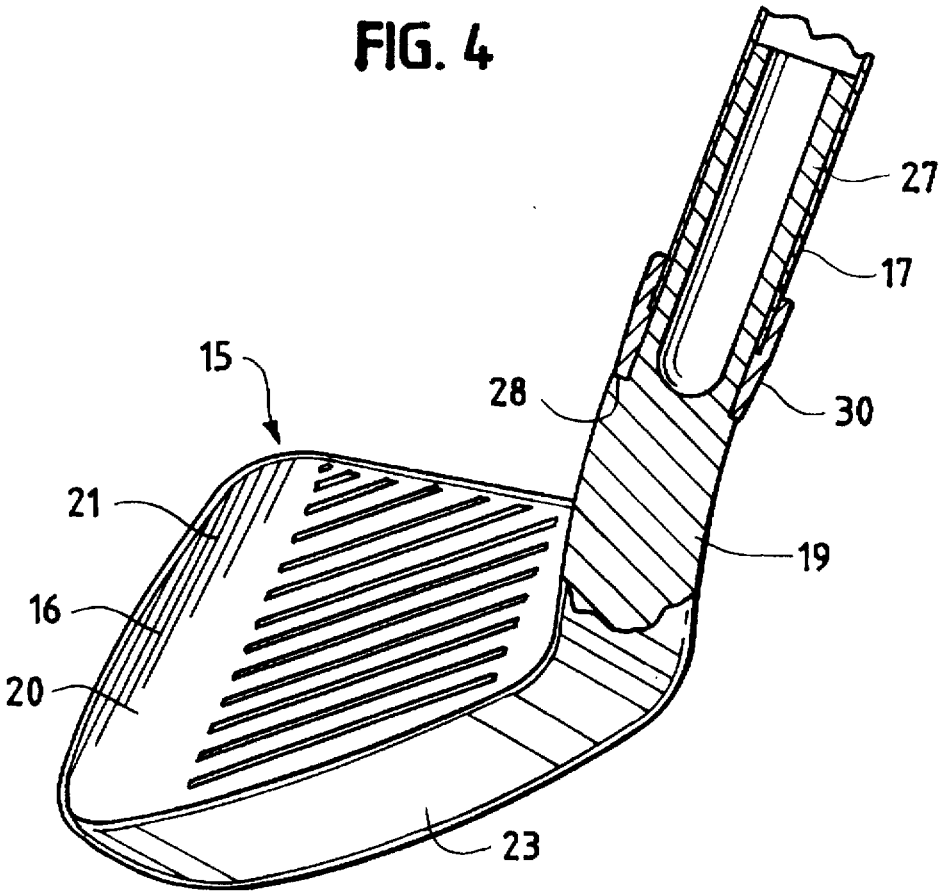
FIG. 4 is a fragmentary perspective view of the club.

Referring to FIG. 4, the diameter of the lower cylindrical inside surface 38 of the ferrule is sized to fit over the attaching portion 27 of the hosel, and the lower end 33 of the ferrule abuts the annular flange 28 of the hosel. The ferrule may or may not fit snugly on the attaching portion 27. The upper cylindrical portion 39 of the inside surface of the ferrule is spaced slightly radially outwardly of the attaching portion 27 of the hosel, and the shaft 17 is inserted over the attaching portion 27 of the hosel and into the annular gap between the attaching portion 27 and the upper portion of the ferrule. The bottom of the shaft abuts the internal shoulder 40 of the ferrule, which provides an abutment or stop for the shaft. The shaft can be suitably secured to the attaching portion 27 of the hosel by conventional means such as epoxy or adhesive. The ferrule completely covers the lower end of the shaft and the junction between the shaft and the hosel and covers any excess adhesive or epoxy which flows outwardly from the bottom of the shaft.

The bottom of the shaft 17 is spaced upwardly from the annular shoulder 28 of the hosel by the internal abutment of the ferrule. The ferrule is made from soft plastic or rubber material which permits the ferrule to deform during loft and/or lie adjustments of the clubhead, and the spacing of the bottom of the shaft from the annular shoulder 28 of the hosel allows the loft and/or lie adjustments to be made without creating any unsightly gap between the bottom of the shaft and the hosel or any interference fit between the bottom of the shaft and the hosel.

In the particular embodiment illustrated, the internal abutment of the ferrule is provided by the annular shoulder 40.

However, the internal abutment can also be provided by other means, such as ribs, an interrupted shelf, etc. The dimension of the internal abutment in a direction perpendicular to the axis of the shaft and the hosel is preferably approximately the same as the thickness of the wall of the tubular shaft so that the upper cylindrical portion 39 of the internal surface of the ferrule fits snugly over the outside of the shaft.

Figure 9:
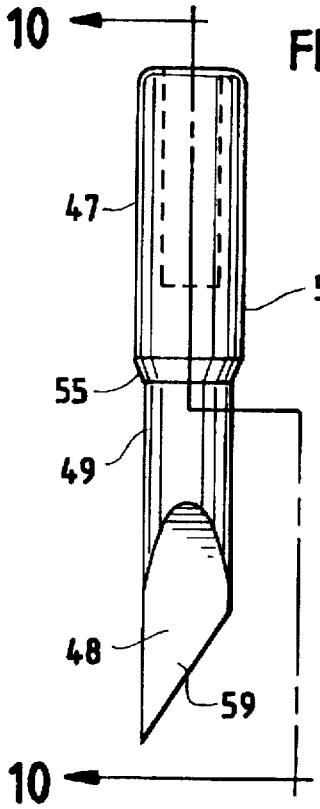
FIG. 9 is an elevational view of the hosel pin of the club of FIG. 8.
Figure 8:
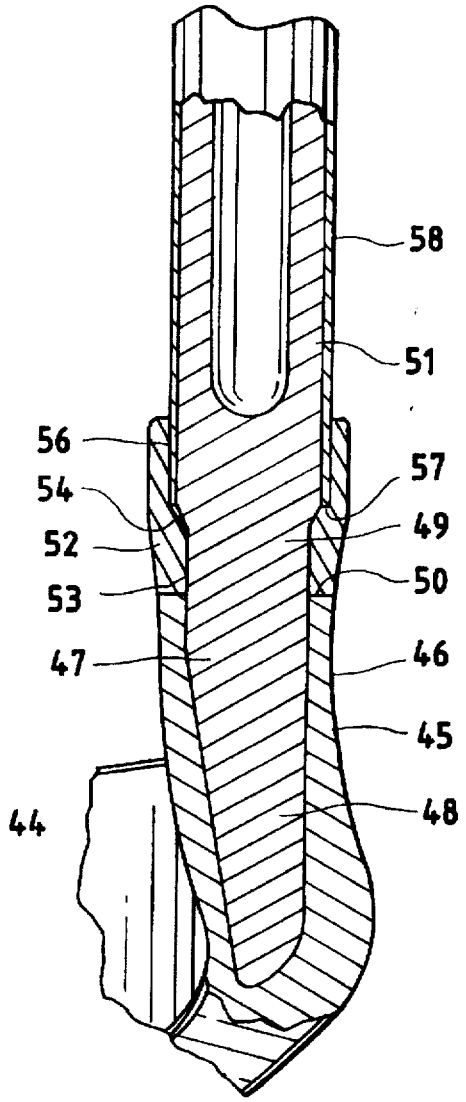
FIG. 8 is a fragmentary sectional view of another embodiment of a club formed in accordance with the invention.
Figure 10:
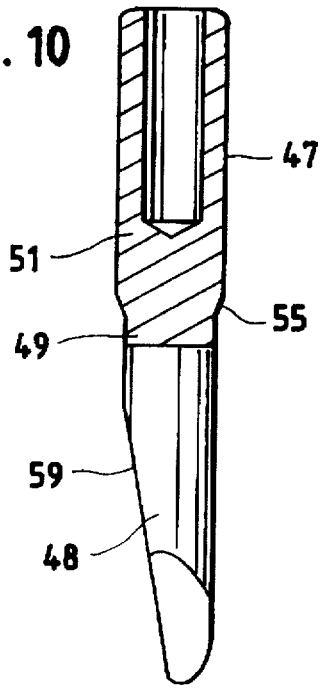
FIG. 10 is a sectional view taken along the line 10—10 of FIG. 9.

FIGS. 8–10 illustrate another embodiment of the invention. A golf clubhead 44 includes a two-part male hosel 45 which includes a hollow tubular portion 46 and a pin 47 which is inserted into the hollow tubular portion 46 and suitably secured, for example, by epoxy. The pin 47 includes a tapered bottom portion 48 which is inserted into the tubular portion 46 of the hosel, an intermediate cylindrical portion 49 which extends above the upper end 50 of the tubular portion 46, and an upper cylindrical end portion 51 which has a diameter slightly larger than the diameter of the intermediate portion 49.

A ferrule 52 abuts the annular shoulder which is provided by the upper end 50 of the tubular portion 46 and includes a lower cylindrical internal surface 53 which abuts the intermediate portion 49 of the pin, an intermediate conical interior surface 54 which abuts a conical portion 55 of the pin, and an upper cylindrical internal surface 56 which is spaced radially outwardly from the upper end portion 51 of the pin. An annular shoulder or abutment 57 extends between the conical internal surface 54 and the upper cylindrical portion 56 of the internal surface of the ferrule. A shaft 58 is inserted into the gap between the ferrule and the pin 51, and the bottom of the shaft abuts the internal shoulder 57 of the ferrule. The shaft is suitably secured by epoxy or the like. As in the previous embodiment, the bottom of the shaft is spaced from the annular shoulder 50 of the tubular portion 46 of the hosel by the internal abutment of the ferrule so that loft and/or lie adjustments can be made without creating gaps or interference between the shaft and the tubular portion of the hosel.

The pin 47 of the two-part hosel is advantageously formed from a material which is lighter or less dense than the material of the tubular portion 46 of the hosel in order to reduce the weight of the clubhead. The tubular portion 46 is advantageously formed integrally with the remainder of the clubhead, and the clubhead can be formed from conventional material, for example, stainless steel. The hosel pin 47 can be formed from titanium, which is about as strong as stainless steel but has only about two thirds the density of stainless steel.

In the particular embodiment illustrated, the lower tapered portion 48 of the pin is formed with a flat surface 59 which mates with a correspondingly shaped flat internal surface of the tubular portion 46 of the hosel in order to prevent relative rotation between the pin and the tubular portion.

Figure 11:
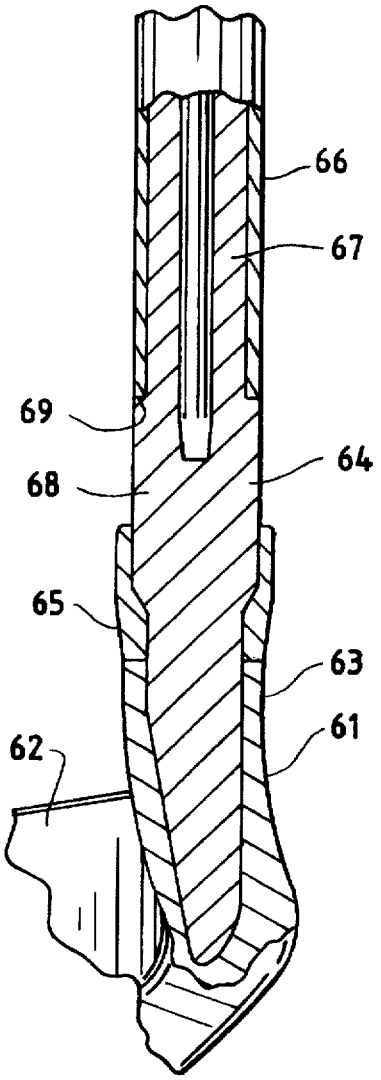
FIG. 11 is a fragmentary sectional view of another embodiment of a club formed in accordance with the invention.
Figure 12:
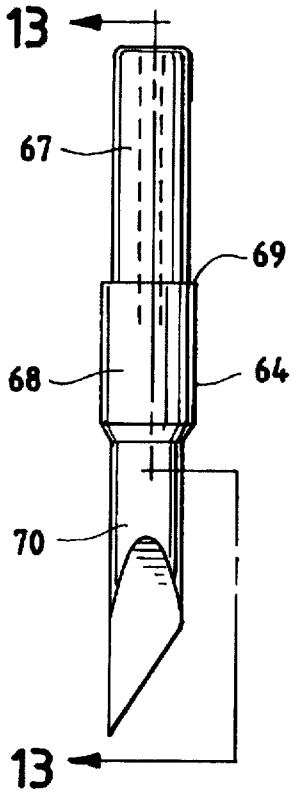
FIG. 12 is an elevational view of the hosel pin of the club of FIG. 11.
Figure 13:
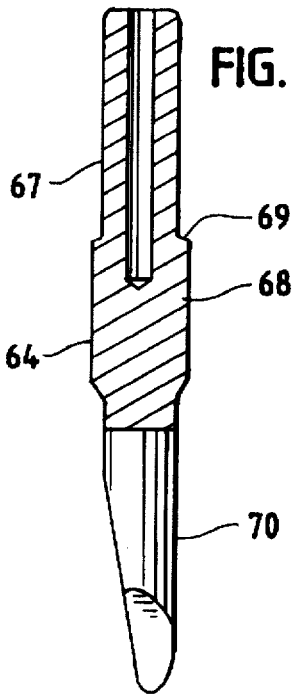
FIG. 13 is a sectional view taken along the line 13—13 of FIG. 12.

FIGS. 11–13 illustrate still another embodiment of a male hosel 61 for a clubhead 62. The male hosel includes a tubular hosel portion 63 which is similar to the tubular hosel portion 46 of FIG. 8, and a pin 64 which is similar to the pin 47 of FIG. 8. A ferrule 65 covers the portion of the hosel pin 64 which extends above the tubular portion 63 of the hosel. However, the shaft 66 is not inserted between the ferrule and the hosel pin. Instead, the hosel pin includes a reduced diameter upper cylindrical portion 67 which is joined to the intermediate cylindrical portion 68 by an annular shoulder 69. The shaft 66 is inserted over the reduced-diameter upper end portion 67, and the bottom end of the shaft abuts the shoulder 69. The hosel pin 64 includes a lower end portion 70 which is similar to the lower end portion of the hosel pin of FIG. 8.

The bottom of the shaft is spaced from the tubular portion 63 of the hosel by the annular shoulder 69 on the hosel pin, and the ferrule 65 conceals any gaps which might be created between the hosel pin 64 and the tubular hosel portion 63 during loft and/or lie adjustments. The hosel pin 64 is also advantageously formed from lightweight material such as titanium.

While in the foregoing specification a detailed description of specific embodiments of the invention was set forth for the purpose of illustration, it will be understood that many of the details herein given can be varied considerably by those skilled in the art without departing from the spirit and scope of the invention.

I claim:

1. A golf club comprising:

a clubhead having a striking face, a toe portion, a heel portion, and a male hosel extending from the heel portion, the hosel including an attaching portion and an annular shoulder which extends outwardly from the attaching portion, a tubular ferrule having first and second ends and an internal bore extending through the ferrule and provided by an internal surface, the internal surface having:

a first portion adjacent the first end providing a first portion of the bore which is sized to fit over the attaching portion of the hosel;

a second portion adjacent the second end of the ferrule providing a second portion of the bore which is larger than the first portion of the bore, the second portion of the internal surface being spaced outwardly from the attaching portion of the hosel, and an abutment portion between the first and second portions, a tubular shaft which is positioned between the attaching portion of the hosel and the second portion of the internal surface of the ferrule and which includes a lower end which abuts the abutment portion of the internal surface, the ferrule being formed from material which is softer than the material of the hosel whereby the ferrule can deform when the loft or lie angle of the club is adjusted.

2. The golf club of claim 1 in which the shaft and the attaching portion of the hosel are generally cylindrical, and the first and second portions of the internal surface of the ferrule are generally cylindrical.

3. The golf club of claim 2 in which the abutment portion of the internal surface of the ferrule is an annular shoulder which extends between the first and second cylindrical portions of the internal surface.

4. The golf club of claim 1 in which the abutment portion of the internal surface of the ferrule is an annular shoulder.

5. The golf club of claim 1 in which the attaching portion of the hosel includes a hollow tubular portion and a pin which extends into the hollow tubular portion, the hollow tubular portion of the hosel and the pin being formed from different metals.

6. The golf club of claim 5 in which the pin is formed from titanium.

7. The golf club of claim 6 in which the clubhead and the tubular portion of the attaching portion of the hosel are formed from stainless steel.

* * * * *